US011158453B2

(12) United States Patent
Kang et al.

(10) Patent No.: US 11,158,453 B2
(45) Date of Patent: Oct. 26, 2021

(54) COIL COMPONENT

(71) Applicant: SAMSUNG ELECTRO-MECHANICS CO., LTD., Suwon-si (KR)

(72) Inventors: Byung Soo Kang, Suwon-si (KR); Joung Gul Ryu, Suwon-si (KR); Byeong Cheol Moon, Suwon-si (KR); Yong Hui Li, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 192 days.

(21) Appl. No.: 16/126,692

(22) Filed: Sep. 10, 2018

(65) Prior Publication Data

US 2019/0304672 A1 Oct. 3, 2019

(30) Foreign Application Priority Data

Mar. 27, 2018 (KR) ..... 10-2018-0035325

(51) Int. Cl.
*H01F 27/29* (2006.01)
*H01F 27/36* (2006.01)
(Continued)

(52) U.S. Cl.
CPC ..... *H01F 27/36* (2013.01); *H01F 27/2804* (2013.01); *H01F 27/292* (2013.01); *H01F 27/327* (2013.01); *H01F 2027/2809* (2013.01)

(58) Field of Classification Search
CPC .... H01F 27/36; H01F 27/2804; H01F 27/292; H01F 27/327; H01F 27/363;
(Continued)

(56) References Cited

U.S. PATENT DOCUMENTS 8,791,783 B2 * 7/2014 Miyazaki ..... H05K 1/185 336/192
9,126,491 B2 * 9/2015 Ichikawa ..... B60L 53/38
(Continued)

FOREIGN PATENT DOCUMENTS

CN 203013434 U 6/2013
CN 103714945 A 4/2014
(Continued)

OTHER PUBLICATIONS

Japanese Office Action dated Feb. 5, 2019 issued in Japanese Patent Application No. 2018-170594 (with English translation).
(Continued)

*Primary Examiner* — Mang Tin Bik Lian
(74) *Attorney, Agent, or Firm* — Morgan, Lewis & Bockius LLP

(57) ABSTRACT

A coil component includes: a body having one surface and the other surface opposing each other in one direction; a coil portion including a coil pattern embedded in the body and having at least one turn in the one direction; an insulating layer surrounding the body; an external electrode connected to the coil portion, penetrating through he insulating layer, and disposed on the one surface of the body; a shielding layer disposed on the insulating layer and disposed at least on the other surface of the body opposing the one surface of the body;

and a seed layer disposed between the insulating layer and the shielding layer.

32 Claims, 14 Drawing Sheets

(51) Int. Cl.
*H01F 27/28* (2006.01)
*H01F 27/32* (2006.01)

(58) Field of Classification Search
CPC ..... H01F 2027/2809; H01F 17/0006; H01F 2017/048; H01F 2017/008
See application file for complete search history.

(56) References Cited

U.S. PATENT DOCUMENTS

| | | | | |
|---|---|---|---|---|
| 9,583,251 | B2 * | 2/2017 | Moon | H01F 27/292 |
| 10,600,560 | B2 | 3/2020 | Masuda et al. | |
| 10,854,383 | B2 | 12/2020 | Choi | |
| 10,879,005 | B2 | 12/2020 | Maki et al. | |
| 2006/0220737 | A1 * | 10/2006 | Sanderson | H03B 5/1841 330/69 |
| 2012/0274432 | A1 * | 11/2012 | Jeong | H01F 17/0033 336/192 |
| 2013/0293334 | A1 * | 11/2013 | Shin | H01F 17/0033 336/192 |
| 2014/0159854 | A1 * | 6/2014 | Samala | H01F 17/0006 336/84 C |
| 2016/0247624 | A1 | 8/2016 | Seo et al. | |
| 2016/0268038 | A1 * | 9/2016 | Choi | H01F 27/255 |
| 2017/0110240 | A1 | 4/2017 | Masuda et al. | |
| 2017/0162316 | A1 * | 6/2017 | Endo | H01F 27/2804 |
| 2017/0200682 | A1 * | 7/2017 | Lin | H01L 24/97 |
| 2017/0271081 | A1 | 9/2017 | Maki et al. | |
| 2017/0323725 | A1 | 11/2017 | Iso et al. | |
| 2018/0166211 | A1 * | 6/2018 | Takatsuji | H01F 17/04 |
| 2018/0286568 | A1 * | 10/2018 | Suzuki | H01F 41/122 |
| 2020/0329592 | A1 | 10/2020 | Seo et al. | |

FOREIGN PATENT DOCUMENTS

| | | | | |
|---|---|---|---|---|
| CN | 105957692 | A | 9/2016 | |
| CN | 206225116 | U | 6/2017 | |
| CN | 206301679 | U | 7/2017 | |
| CN | 107004493 | A | 8/2017 | |
| CN | 107017854 | A | 8/2017 | |
| CN | 107210129 | A | 9/2017 | |
| CN | 109315084 | A | 2/2019 | |
| JP | 58184710 | A | * 10/1983 | H01F 27/36 |
| JP | 2005-310863 | A | 11/2005 | |
| JP | 2011-124373 | A | 6/2011 | |
| JP | 2016-111280 | A | 6/2016 | |
| JP | 2017-054891 | A | 3/2017 | |
| JP | 2017-076796 | A | 4/2017 | |
| JP | 2017-103359 | A | 6/2017 | |
| KR | 10-2016-0108935 | A | 9/2016 | |
| KR | 10-2017-0084156 | A | 7/2017 | |
| KR | 10-2017-0136063 | A | 12/2017 | |

OTHER PUBLICATIONS

Office Action issued in corresponding Korean Application No. 10-2018-0035325, dated Apr. 19, 2019.
Office Action issued in corresponding Chinese Patent Application No. 201811354026.0 dated Feb. 1, 2021, with English translation.
Office Action issued in corresponding Chinese Patent Application No. 201811354026.0 dated Sep. 3, 2021, with English translation.

* cited by examiner

COIL COMPONENT

CROSS-REFERENCE TO RELATED APPLICATION(S)

This application claims benefit of priority to Korean Patent Application No. 10-2018-0035325 filed on Mar. 27, 2018 in the Korean Intellectual Property Office, the disclosure of which is incorporated herein by reference in its entirety.

TECHNICAL FIELD

The present disclosure relates to a coil component.

BACKGROUND

An inductor, a coil component, is a representative passive electronic component used in an electronic device, together with a resistor and a capacitor.

In accordance with gradual performance improvements and decreases in the size of electronic devices, the number of electronic components used in the electronic device has increased, and sizes of the electronic components have been decreased.

For the reason described above, demand for removal of a noise generation source such as electromagnetic interference (EMI) of the electronic components has gradually increased.

In current general EMI shielding technology, the electronic components are mounted on a board, and the electronic components and the board are then surrounded simultaneously by a shield can.

SUMMARY

An aspect of the present disclosure may provide a coil component in which leakage magnetic flux may be decreased.

An aspect of the present disclosure may also provide a coil component of which characteristics may be substantially maintained while decreasing leaked magnetic flux.

According to an aspect of the present disclosure, a coil component may include: a body having one surface and the other surface opposing each other in one direction; a coil portion including a coil pattern, having at least one turn in the one direction, and embedded in the body; an insulating layer surrounding the body; a shielding layer disposed on the insulating layer and disposed at least on the other surface of the body opposing the one surface of the body; and a seed layer disposed between the insulating layer and the shielding layer.

The shielding layer may include a cap portion disposed on the other surface of the body; and sidewall portions disposed on a plurality of walls of the body, respectively.

At least portions of the seed layer may penetrate into the insulating layer.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
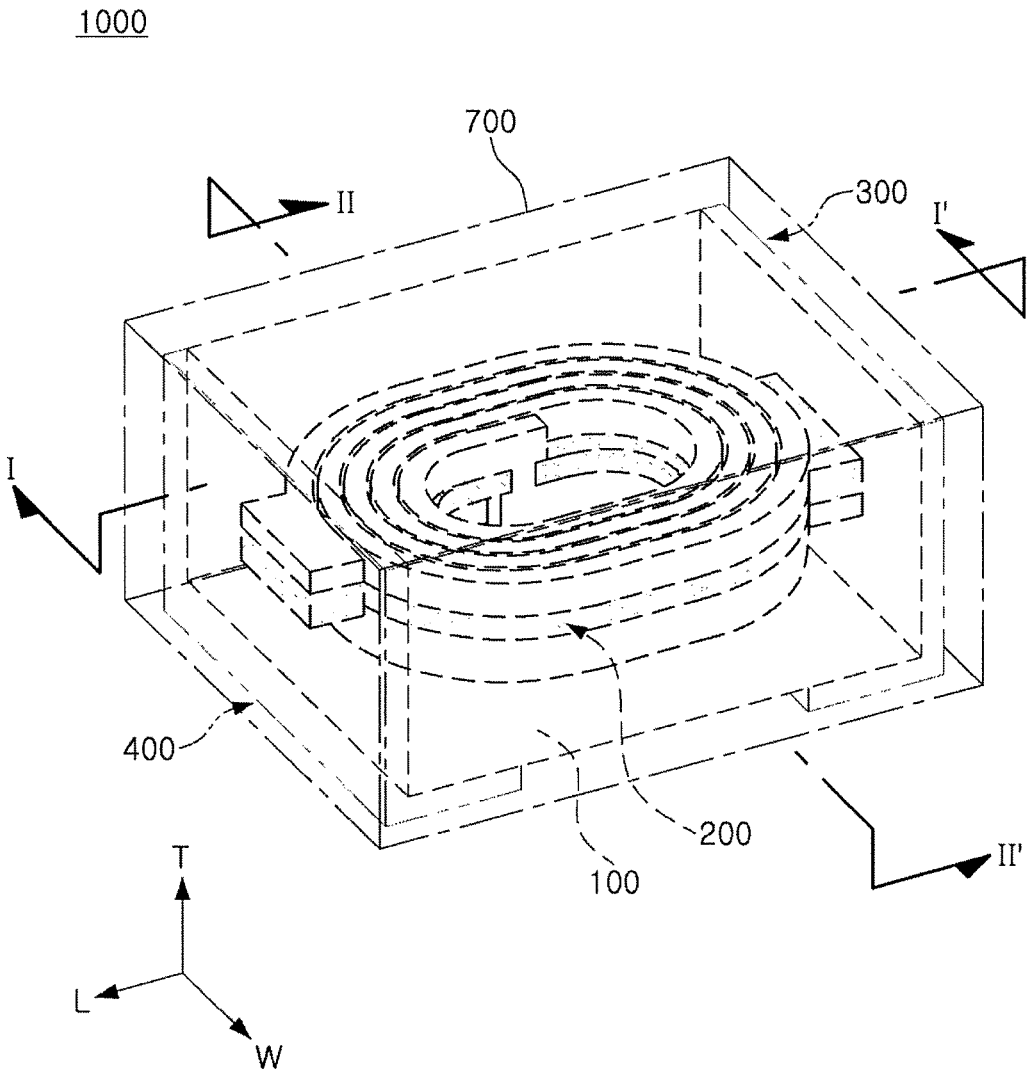
FIG. 1 is a schematic perspective view illustrating a coil component according to a first exemplary embodiment in the present disclosure.

Hereinafter, exemplary embodiments of the present disclosure will be described in detail with reference to the accompanying drawings.

In the drawings, an L direction refers to a first direction or a length direction, a W direction refers to a second direction or a width direction, and a T direction refers to a third direction or a thickness direction.

Hereinafter, coil components according to exemplary embodiment in the present disclosure will be described in detail with reference to the accompanying drawings. In describing exemplary embodiments in the present disclosure with reference to the accompanying drawings, components that are the same as or correspond to each other will be denoted by the same reference numerals, and an overlapping description therefor will be omitted.

Various kinds of electronic components may be used in an electronic device, and various kinds of coil components may be appropriately used between these electronic components depending on their purposes in order to remove noise, or the like.

That is, the coil components used in the electronic device may be a power inductor, high frequency (HF) inductors, a general bead, a bead for a high frequency (GHz), a common mode filter, and the like.

First Exemplary Embodiment

Figure 2A:
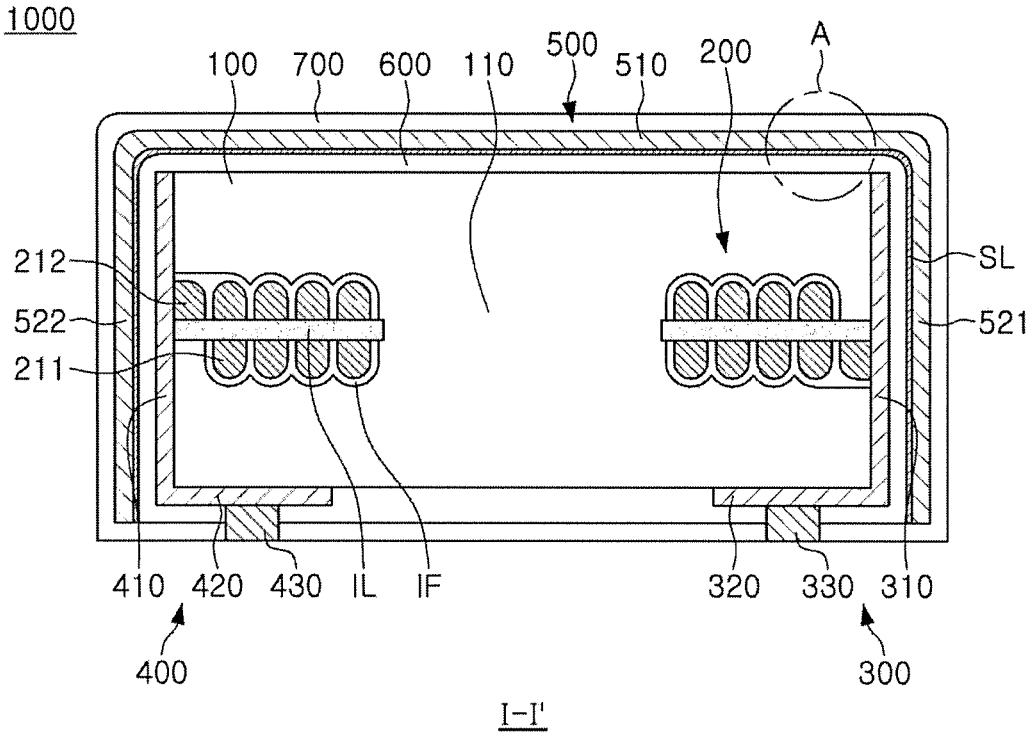
FIG. 2A is a cross-sectional view taken along line I-I' of FIG. 1.
Figure 2B:
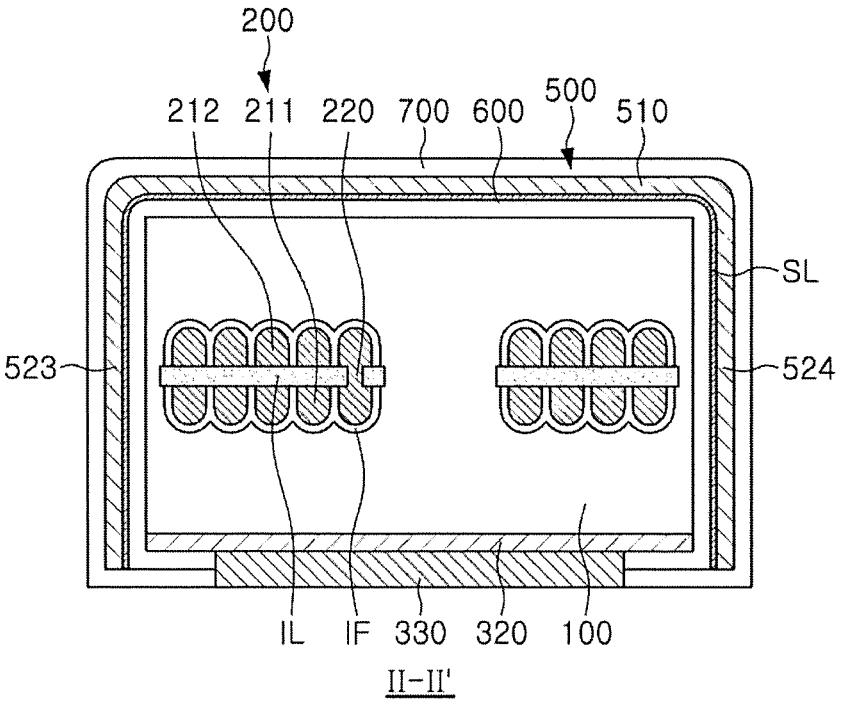
FIG. 2B is a cross-sectional view taken along line II-II' of FIG. 1, and FIGS. 2C through 2E are enlarged views of part A of FIG. 2A.
Figure 2C:
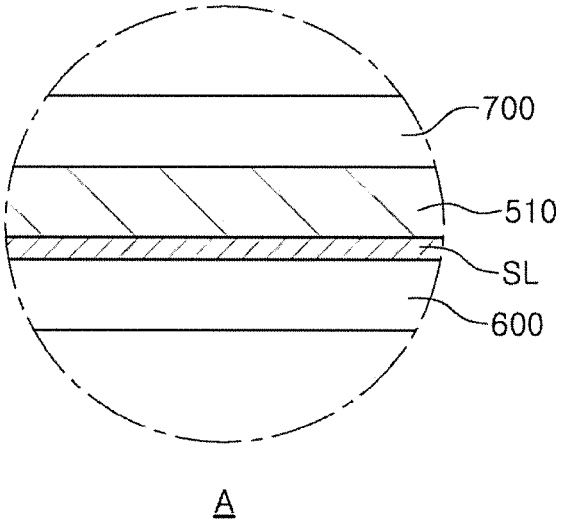
Figure 2D:
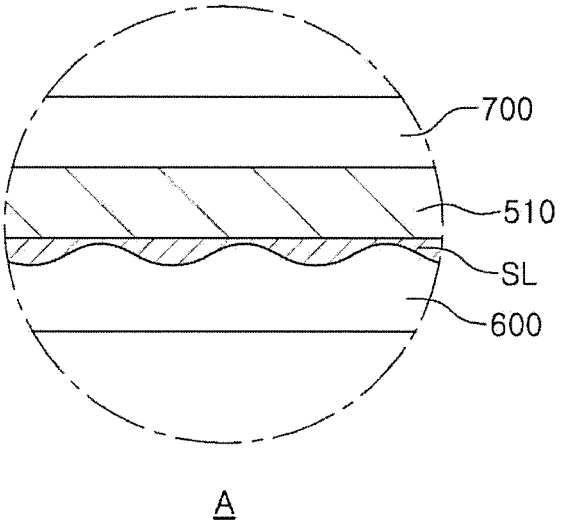
Figure 2E:
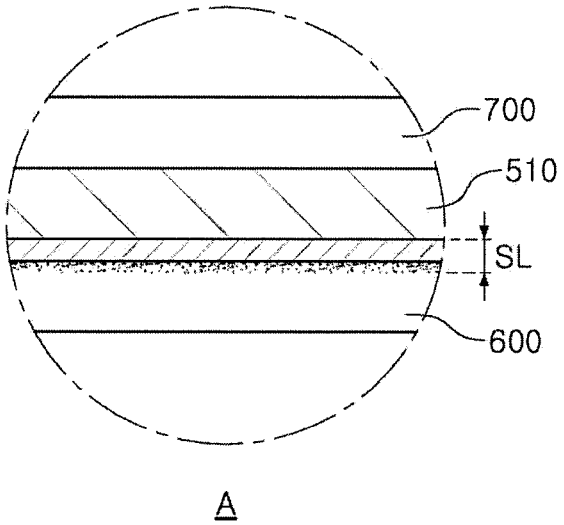

FIG. 1 is a schematic perspective view illustrating a coil component according to a first exemplary embodiment in the present disclosure. FIG. 2A is a cross-sectional view taken along line I-I' of FIG. 1. FIG. 2B is a cross-sectional view taken along line II-II' of FIG. 1. FIGS. 2C through 2E are enlarged views of part A of FIG. 2A.

Referring to FIGS. 1 through 2E, a coil component 1000 according to a first exemplary embodiment in the present disclosure may include a body 100, a coil portion 200, external electrodes 300 and 400, a shielding layer 500, an insulating layer 600, and a seed layer SL, and may further include a cover layer 700, an internal insulating layer IL, and an insulating film IF.

The body 100 may form an appearance of the coil component 1000 according to the present exemplary embodiment, and may embed the coil portion 200 therein.

The body 100 may generally have a hexahedral shape.

A first exemplary embodiment in the present disclosure will hereinafter be described on the assumption that the body 100 has the hexahedral shape. However, such a description does not exclude a coil component including a body having a shape other than the hexahedral shape from the scope of the present exemplary embodiment.

The body 100 may have a first surface and a second surface opposing each other in the length direction (L), a third surface and a fourth surface opposing each other in the width direction (W), and a fifth surface and a sixth surface opposing each other in the thickness direction (T).

The body 100 may be formed so that the coil component 1000 according to the present exemplary embodiment in which external electrodes 300 and 400, an insulating layer 600, a shielding layer 500, and a cover layer 700 to be described below are formed may have a length of 2.0 mm, a width of 1.2 mm, and a thickness of 0.65 mm, but is not limited thereto.

The body 100 may include magnetic materials and a resin. In detail, the body may be formed by stacking one or more magnetic composite sheets in which the magnetic materials are dispersed in the resin. However, the body 100 may also have a structure other than a structure in which the magnetic materials are dispersed in the resin. For example, the body 100 may be formed of a magnetic material such as ferrite.

The magnetic material may be ferrite or metal magnetic powder particles.

The ferrite may be, for example, one or more of spinel type ferrites such as Mg—Zn-based ferrite, Mn—Zn-based ferrite, Mn—Mg-based ferrite, Cu—Zn-based ferrite, Mg—Mn—Sr-based ferrite, or Ni—Zn-based ferrite, hexagonal ferrites such as Ba—Zn-based ferrite, Ba—Mg-based ferrite, Ba—Ni-based ferrite, Ba—Co-based ferrite, or Ba—Ni—Co-based ferrite, or garnet type ferrite such as Y-based ferrite or Li-based ferrite.

The metal magnetic powder particles may include one or more selected from the group consisting of iron (Fe), silicon (Si), chromium (Cr), cobalt (Co), molybdenum (Mo), aluminum (Al), niobium (Nb), copper (Cu), and nickel (Ni). For example, the metal magnetic powder particles maybe one or more of pure iron powder particles, Fe—Si-based alloy powder particles, Fe—Si—Al-based alloy powder particles, Fe—Ni-based alloy powder particles, Fe—Ni—Mo-based alloy powder particles, Fe—Ni—Mo—Cu-based alloy powder particles, Fe—Co-based alloy powder particles, Fe—Ni—Co-based alloy powder particles, Fe—Cr-based alloy powder particles, Fe—Cr—Si-based alloy powder particles, Fe—Si—Cu—Nb-based alloy powder particles, Fe—Ni—Cr-based alloy powder particles, and Fe—Cr—Al-based alloy powder particles.

The metal magnetic powder particles may be amorphous or crystalline. For example, the metal magnetic powder particles may be Fe—Si—B—Cr based amorphous alloy powder particles, but are not necessarily limited thereto.

The ferrite and the metal magnetic powder particles may have average diameters of about 0.1 μm to 30 μm, respectively, but are not limited thereto.

The body 100 may include two kinds or more of magnetic materials dispersed in the resin. Here, different kinds of magnetic materials mean that the magnetic materials disposed in the resin are distinguished from each other by any one of an average diameter, a composition, crystallinity, and a shape.

The resin may include epoxy, polyimide, liquid crystal polymer (LCP), or the like, or mixtures thereof, but is not limited thereto.

The body 100 may include a core 110 penetrating through a coil portion 200 to be described below. The core 110 may be formed by filling a through-hole of the coil portion 200 with a magnetic composite sheet, but is not limited thereto.

The coil portion 200 may be embedded in the body 100, and may implement characteristics of the coil component. For example, when the coil component 1000 is used as a power inductor, the coil portion 200 may serve to store an electric field as a magnetic field to maintain an output voltage, resulting in stabilization of power of an electronic device.

The coil portion 200 may include a first coil pattern 211, a second coil pattern 212, and a via 220.

The first coil pattern 211, the second coil pattern 212, and an internal insulating layer IL to be described below may be sequentially stacked in the thickness direction (T) of the body 100.

Each of the first coil pattern 211 and the second coil pattern 212 may have a planar spiral shape. As an example, the first coil pattern 211 may form at least one turn in the thickness direction (T) of the body 100 on one surface of the internal insulating layer IL.

The via 220 may penetrate through the internal insulating layer IL to electrically connect the first coil pattern 211 and the second coil pattern 212 to each other, and may be in contact with each of the first coil pattern 211 and the second coil pattern 212. Resultantly, the coil portion 200 according to the present exemplary embodiment may be formed of one coil generating a magnetic field in the thickness direction (T) of the body 100.

At least one of the first coil pattern 211, the second coil pattern 212, and the via 220 may include one or more conductive layers.

As an example, when the second coil pattern 212 and the via 220 are formed by plating, each of the second coil pattern 212 and the via 220 may include an internal seed layer of an electroless plating layer and an electroplating layer. Here, the electroplating layer may have a single-layer structure or have a multilayer structure. The electroplating layer having the multilayer structure may be formed in a conformal film structure in which another electroplating layer covers any one electroplating layer, or may be formed in a shape in which another electroplating layer is stacked on only one surface of any one electroplating layer. The internal seed layer of the second coil pattern 212 and the internal seed layer of the via 220 may be formed integrally with each other, such that a boundary therebetween may not be formed, but are not limited thereto. The electroplating layer of the second coil pattern 212 and the electroplating layer of the via 220 may be formed integrally with each other, such that a boundary therebetween may not be formed, but are not limited thereto.

As another example, when the coil portion 200 is formed by separately forming the first coil pattern 211 and the second coil pattern 212 and then collectively stacking the first coil pattern 211 and the second coil pattern 212 below and on the internal insulating layer IL, respectively, the via 220 may include a high melting point metal layer and a low melting point metal layer having a melting point lower than that of the high melting point metal layer. Here, the low melting point metal layer may be formed of a solder including lead (Pb) and/or tin (Sn). At least a portion of the low melting point metal layer may be melted due to a pressure and a temperature at the time of collectively stacking, such that an inter-metallic compound (IMC) layer may be formed on a boundary between the low melting point metal layer and the second coil pattern 212.

The first coil pattern 211 and the second coil pattern 212 may protrude on a lower surface and an upper surface of the internal insulating layer IL, respectively, as an example. As another example, the first coil pattern 211 may be embedded in a lower surface of the internal insulating layer IL, such that a lower surface of the first coil pattern 211 may be exposed to the lower surface of the internal insulating layer IL, and the second coil pattern 212 may protrude on an upper surface of the internal insulating layer IL. In this case, concave portions may be formed in the lower surface of the first coil pattern 211, such that the lower surface of the internal insulating layer IL and the lower surface of the first coil pattern 211 may not be disposed to be coplanar with each other. As another example, the first coil pattern 211 may be embedded in a lower surface of the internal insulating layer IL, such that a lower surface of the first coil pattern 211 may be exposed to the lower surface of the internal insulating layer IL, and the second coil pattern 212 may be embedded in an upper surface of the internal insulating layer IL, such that an upper surface of the second coil pattern 212 may be exposed to the upper surface of the internal insulating layer IL.

End portions of the first coil pattern 211 and the second coil pattern 212 may be exposed to the first surface and the second surface of the body 100, respectively. The end portion of the first coil pattern 211 exposed to the first surface of the body 100 may be in contact with a first external electrode 300 to be described below, such that the first coil pattern 211 may be electrically connected to the first external electrode 300. The end portion of the second coil pattern 212 exposed to the second surface of the body 100 may be in contact with a second external electrode 400 to be described below, such that the second coil pattern 212 may be electrically connected to the second external electrode 400.

Each of the first coil pattern 211, the second coil pattern 212, and the via 220 may be formed of a conductive material such as copper (Cu), aluminum (Al), silver (Ag), tin (Sn), gold (Au), nickel (Ni), lead (Pb), titanium (Ti), or alloys thereof, but is not limited thereto.

The internal insulating layer IL may be formed of an insulating material including a thermosetting resin such as an epoxy resin, a thermoplastic resin such as a polyimide resin, or a photosensitive insulating resin, or be formed of an insulating material having a reinforcement material such as a glass fiber or an inorganic filler impregnated in such an insulating resin. As an example, the internal insulating layer IL may be formed of an insulating material such as prepreg, an Ajinomoto Build-up Film (ABF), FR-4, a Bismaleimide Triazine (BT) resin, a photoimagable dielectric (PID), or the like, but is not limited thereto.

As the inorganic filler, one or more materials selected from the group consisting of silica ($SiO_2$), alumina ($Al_2O_3$), silicon carbide (SiC), barium sulfate ($BaSO_4$), talc, clay, mica powder particles, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the internal insulating layer IL is formed of the insulating material including the reinforcing material, the internal insulating layer IL may provide more excellent rigidity. When the internal insulating layer IL is formed of an insulating material that does not include a glass fiber, the internal insulating layer IL may be advantageous for decreasing an entire thickness of the coil portion 200. When the internal insulating layer IL is formed of the insulating material including the photosensitive insulating resin, the number of processes may be decreased, which is advantageous for decreasing production costs, and a fine hole may be drilled.

The insulating film IF may be formed along surfaces of the first coil pattern 211, the internal insulating layer IL, and the second coil pattern 212. The insulating film IF may be provided in order to protect and insulate the first and second coil patterns 211 and 212, and may include any known insulating material such as parylene, or the like. The insulating material included in the insulating film IF is not particularly limited, but may be any insulating material. The insulating film IF may be formed by a method such as vapor deposition, or the like, but is not limited thereto. That is, the insulating film IF may be formed by stacking insulating films on opposite surfaces of the internal insulating layer IL on which the first and second coil patterns 211 and 212 are formed.

Meanwhile, although not illustrated, the number of at least one of first and second coil patterns 211 and 212 may be plural. As an example, the coil portion 200 may include a plurality of first coil patterns 211, and may have a structure in which another first coil pattern is stacked on a lower surface of any one first coil pattern. In this case, an additional insulating layer may be disposed between the plurality of first coil patterns 211, but is not limited thereto.

The insulating layer 600 may surround the body, and may electrically isolate a shielding layer 500 to be described below from the body 100 and the external electrodes 300 and 400. In the present exemplary embodiment, the insulating layer 600 may be disposed over all of the first to sixth surfaces of the body 100. Meanwhile, in the present exemplary embodiment, connection portions 310 and 410 of the external electrodes 300 and 400 to be described below are formed on the first and second surfaces of the body 100, respectively, and the insulating layer 600, the seed layer SL, and the shielding layer 500 may be sequentially disposed on each of the connection portions 310 and 410 of the external electrodes 300 and 400.

The insulating layer 600 may include a thermoplastic resin such as polystyrenes, vinyl acetates, polyesters, polyethylenes, polypropylenes, polyamides, rubbers, or acryls, a thermosetting resin such as phenols, epoxies, urethanes, melamines, or alkyds, a photosensitive resin, parylene, or $SiN_x$. The insulating layer 600 and the body 100 may be made of different materials.

The insulating layer 600 may be formed by applying a liquid-phase insulating resin to the body 100, stacking an insulating film such as a dry film (DF) on the body 100, or forming an insulating resin on a surface of the body 100 by vapor deposition. The insulating film may be an ABF that does not include a photosensitive insulating resin, a polyimide film, or the like.

The insulating layer 600 may be formed in a thickness range of 10 nm to 100 μm. When a thickness of the insulating layer 600 is less than 10 nm, characteristics of the coil component such as a Q factor, or the like, may be decreased, and when a thickness of the insulating layer 600 exceeds 100 μm, an entire length, width, and thickness of the coil component may be excessively increased, which is disadvantageous for thinness of the coil component.

The external electrodes 300 and 400 may be disposed on one surface of the body 100, and may be connected to the coil patterns 211 and 212, respectively. The external electrodes 300 and 400 may include the first external electrode 300 connected to the first coil pattern 211 and the second external electrode 400 connected to the second coil pattern 212. In detail, the first external electrode 300 may include a first connection portion 310 disposed on the first surface of the body 100 and connected to the end portion of the first coil pattern 211, a first extending portion 320 extending from the first connection portion 310 to the sixth surface of the body 100, and a first penetrating portion 330 penetrating through an opening of the insulating layer 600 and connected to the first extending portion 320. The second external electrode 400 may include a second connection portion 410 disposed on the second surface of the body 100 and connected to the end portion of the second coil pattern 212, a second extending portion 420 extending from the second connection portion 410 to the sixth surface of the body 100, and a second penetrating portion 430 penetrating through another opening of the insulating layer 600 and connected to the second extending portion 420. The first extending portion 320 and the second extending portion 420 may be spaced apart from each other and the first penetrating portion 330 and the second penetrating portion 430 may be spaced apart from each other so that the first external electrode 300 and the second external electrode 400 are not in contact with each other.

The external electrodes 300 and 400 may electrically connect the coil component 1000 to a printed circuit board, or the like, when the coil component 1000 according to the present exemplary embodiment is mounted on the printed circuit board, or the like. As an example, the coil component 1000 according to the present exemplary embodiment may be mounted on the printed circuit board so that the sixth surface of the body 100 faces an upper surface of the printed circuit board, and the penetrating portions 330 and 430 of the external electrodes 300 and 400 disposed on the sixth surface of the body 100 and connection portions of the printed circuit board may be electrically connected to each other by solders, or the like.

The external electrodes 300 and 400 may include conductive resin layers and conductive layers formed on the conductive resin layers, respectively. The conductive resin layer may be formed by printing a paste, and may include one or more conductive metals selected from the group consisting of copper (Cu), nickel (Ni), and silver (Ag), and a thermosetting resin. The conductive layer may include one or more selected from the group consisting of nickel (Ni), copper (Cu), and tin (Sn), and may be formed by, for example, plating.

As an example, the connection portions 310 and 410 and the extending portions 320 and 420 may be formed integrally with each other by the same electrolytic copper plating process, and the penetrating portions 330 and 430 may be in contact with portions of the extending portions 320 and 420 by penetrating through the insulating layer 600 and the cover layer 700 after forming the insulating layer 600 and the cover layer 700 and be then formed on the exposed extending portions 320 and 420, respectively, but the connection portions 310 and 410, the extending portions 320 and 420, and the penetrating portions 330 and 430 are not limited thereto. As an example, the penetrating portions 330 and 430 may include nickel plating layers in contact with the extending portions 320 and 420 and tin plating layers formed on the nickel plating layers, respectively. In this case, the penetrating portions 330 and 430 may be made of a material different from that used to form the connection portions 310 and 410 and the extending portions 320 and 420. As another example, the penetrating portions 330 and 430 may be copper plating layers in contact with the extending portions 320 and 420, respectively. Although the drawings show that lower surfaces of the penetrating portions 330 and 430 are coplanar with a lower surface of the cover layer 700, the present disclosure is not limited thereto. For example, the penetrating portions 330 and 430 may include portions protruding downward from the lower surface of the cover layer 700.

The seed layer SL may be formed between the insulating layer 600 and a shielding layer 500 to be described below. In the present exemplary embodiment, a shielding layer 500 to be described below may include a cap portion 510 disposed on the fifth surface of the body 100 and first to fourth sidewall portions 521, 522, 523, and 524 formed, respectively, on the first to fourth surfaces of the body 100, which are walls of the body 100, and the seed layer SL may thus be formed on the first to fifth surfaces of the body 100.

The seed layer SL may be formed by vapor deposition such as electroless plating, sputtering, or the like. In the former case, the seed layer SL may be an electroless copper plating layer, but is not limited thereto. In the latter case, the seed layer SL may include at least one of copper (Cu), gold (Au), platinum (Pt), molybdenum (Mo), titanium (Ti), and chromium (Cr), and may include, for example, a titanium layer and a chromium layer formed on the titanium layer, but is not limited thereto. When the seed layer SL includes at least one of titanium (Ti) and chromium (Cr), the seed layer SL may improve adhesion between a shielding layer 500 to be described below and the insulating layer 600.

Referring to FIG. 2C, the seed layer SL may be formed at a relatively uniform film thickness on the insulating layer 600. Here, the meaning that the seed layer SL is formed at the relatively uniform film thickness is that a thickness distribution of the seed layer SL is relatively constant as compared to a seed layer SL of FIG. 2D. Therefore, when a roughness exists on an upper surface of the insulating layer 600, the seed layer SL may be formed at the uniform film thickness along a shape of the upper surface of the insulating layer 600, such that a roughness corresponding to the roughness of the upper surface of the insulating layer 600 may be formed on an upper surface of the seed layer SL.

Referring to FIGS. 2D and 2E, at least portions of the seed layer SL may penetrate into the insulating layer 600. As an example, as illustrated in FIG. 2D, the seed layer SL may be formed at a non-uniform film thickness on the insulating layer 600. This may be that penetration levels of the seed layer SL are different from each other in adjacent regions of the insulating layer 600, such that a roughness is formed on an interface between the insulating layer 600 and the seed layer SL. As another example, as illustrated in FIG. 2E, particles constituting the seed layer SL may penetrate into the insulating layer 600, such that the seed layer SL includes a mixed layer in which an insulating resin of the insulating layer 600 and the particles constituting the seed layer SL are mixed with each other.

As an example of forming the seed layer SL of FIG. 2C, vapor deposition such as electroless plating, sputtering, or the like, may be used. As an example of forming the seed layers SL illustrated in FIGS. 2D and 2E, a specific kind of vapor deposition method of accelerating vaporized particles for forming a seed layer toward the insulating layer 600 by additional energy may be used, but a method of forming the seed layers SL is not limited thereto.

The shielding layer 500 may be formed on the seed layer SL to be disposed on at least the fifth surface of the body 100, and may decrease leakage magnetic flux externally leaked from the coil component 1000 according to the present exemplary embodiment.

The shielding layer 500 may be formed at a thickness of 10 nm to 100 μm. When the thickness of the shielding layer 500 is less than 10 nm, an electromagnetic interference (EMI) shielding effect may not substantially exist, and when the thickness of the shielding layer 500 exceeds 100 μm, an entire length, width, and thickness of the coil component may be excessively increased, which is disadvantageous for thinness of the coil component.

In the present exemplary embodiment, the shielding layer 500 may include the cap portion 510 disposed on the fifth surface of the body 100 and the first to fourth sidewall portions 521, 522, 523, and 524 disposed, respectively, on the first to fourth surfaces of the body 100, which are the walls of the body 100. The shielding layer 500 according to the present exemplary embodiment may be disposed on all the surfaces of the body 100 except for the sixth surface of the body 100, which is a mounting surface of the coil component 1000 according to the present exemplary embodiment.

The first to fourth sidewall portions 521, 522, 523, and 524 may be formed integrally with one another. That is, the first to fourth sidewall portions 521, 522, 523, and 524 may be formed by the same process, such that boundaries therebetween may not be formed. As an example, the first to fourth sidewall portions 521, 522, 523, and 524 may be formed integrally with one another on the first to fourth surfaces of the body 100 on which the seed layer SL is formed, by performing vapor deposition such as sputtering, or the like. As another example, the first to fourth sidewall portions 521, 522, 523, and 524 may be formed integrally with one another on the first to fourth surfaces of the body 100 on which the seed layer SL is formed, by performing electroplating.

The cap portion 510 and the sidewall portions 521, 522, 523, and 524 may be formed integrally with each other. That is, the cap portion 510 and the sidewall portions 521, 522, 523, and 524 may be formed by the same process, such that boundaries therebetween may not be formed. As an example, the cap portion 510 and the sidewall portions 521, 522, 523, and 524 may be formed integrally with each other on the first to fifth surfaces of the body 100 on which the seed layer SL is formed, by performing vapor deposition such as sputtering. As another example, the cap portion 510 and the sidewall portions 521, 522, 523, and 524 may be formed integrally with each other on the first to fifth surfaces of the body 100 on which the seed layer SL is formed, by performing electroplating.

Each of connection portions of the cap portion 510 and the sidewall portions 521, 522, 523, and 524 may have a curved surface shape. As an example, when the shielding layer 500 is formed on the first to fifth surfaces of the body 100 on which the seed layer SL is formed by the vapor deposition such as the sputtering, a cross section of a region in which the cap portion 510 and the sidewall portions 521, 522, 523, and 524 are connected to each other may be formed as a curved surface. As another example, when the shielding layer 500 is formed on the first to fifth surfaces of the body 100 on which the seed layer SL is formed by the electroplating, a cross section of a region in which the cap portion 510 and the sidewall portions 521, 522, 523, and 524 are connected to each other may be formed as a curved surface.

Each of the first to fourth sidewall portions 521, 522, 523, and 524 may include one end connected to the cap portion 510 and the other end opposing the one end, and a distance from the sixth surface of the body 100 to the other end of any one of the first to fourth sidewall portions 521, 522, 523, and 524 may be different from that from the sixth surface of the body 100 to the other end of another of the first to fourth sidewall portions 521, 522, 523, and 524. As an example, when the shielding layer 500 is formed by the electroplating or the vapor deposition, distances from the other ends of the sidewall portions to the sixth surface of the body 100 may be different from one another due to a tolerance or a need on a design.

Figure 12:
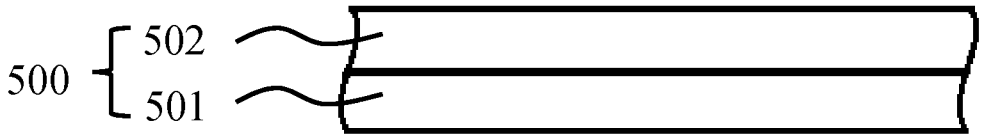
FIG. 12 is a section of a shielding layer shown in FIG. 2 according to one example of the present disclosure.

The shielding layer 500 may include at least one of a conductor and a magnetic material. As an example, the conductor may be a metal or an alloy including one or more selected from the group consisting of copper (Cu), silver (Ag), gold (Au), aluminum (Al), iron (Fe), silicon (Si), boron (B), chromium (Cr), niobium (Nb), and nickel (Ni), and may be Fe—Si or Fe—Ni. In addition, the shielding layer 500 may include one or more selected from the group consisting of ferrite, permalloy, and an amorphous ribbon. The shielding layer 500 may be, for example, a copper plating layer, but is not limited thereto. The shielding layer 500 may have a multilayer structure. As an example, the shielding layer 500 may be formed in a double layer structure including a conductor layer 501 (shown in FIG. 12) and a magnetic layer 502 (shown in FIG. 12) formed on the conductor layer 501, a double layer structure including a first conductor layer (not shown) and a second conductor layer (not shown) formed on the first conductor layer, or a structure of a plurality of conductor layers (not shown). Here, the first and second conductor layers may include different conductors, but may also include the same conductor.

The shielding layer 500 may include two or more fine structures separated from each other. As an example, when each of the cap portion 510 and the sidewall portions 521, 522, 523, and 524 is formed by the sputtering, each of the cap portion 510 and the sidewall portions 521, 522, 523, and 524 may include a plurality of fine structures distinguished from each other by grain boundaries.

The cover layer 700 may be disposed on the shielding layer 500 to cover the shielding layer 500, and may be in contact with the insulating layer 600. That is, the cover layer 700 may embed the shielding layer 500 therein together with the insulating layer 600. In the present exemplary embodiment, the cover layer 700 may be disposed on the first to sixth surfaces of the body 100, and may cover the other end of each of the first to fourth sidewall portions 521, 522, 523, and 524 to be in contact with the insulating layer 600. The cover layer 700 may cover the other end of each of the first to fourth sidewall portions 521, 522, 523, and 524 to prevent electrical connection between the first to fourth sidewall portions 521, 522, 523, and 524 and the external electrodes 300 and 400. In addition, the cover layer 700 may prevent the shielding layer 500 from being electrically connected to other external electronic components.

The cover layer 700 may include at least one of a thermoplastic resin such as polystyrenes, vinyl acetates, polyesters, polyethylenes, polypropylenes, polyamides, rubbers, or acryls, a thermosetting resins such as phenols, epoxies, urethanes, melamines, or alkyds, a photosensitive insulating resin, parylene, $SiO_x$, and $SiN_x$.

The cover layer 700 may be formed by stacking a cover film such as a dry film (DF) on the body 100 on which the shielding layer 500 is formed. Alternatively, the cover layer 700 may be formed by performing vapor deposition such as chemical vapor deposition (CVD), or the like, using an insulating material on the body 100 on which the shielding layer 500 is formed.

The cover layer 700 may have an adhesion function. As an example, when the cover layer 700 is formed by stacking the cover film on the body 100, the cover layer 700 may include an adhesive component to be adhered to the shielding layer 500.

Meanwhile, the cover layer 700 may be penetrated together with the insulating layer 600 by the penetrating portions 330 and 430 of the external electrodes 300 and 400 described above. Through-holes in which the penetrating portions 330 and 430 penetrating through the insulating layer 600 and the cover layer 700 are formed may be formed by a photolithography, a laser drill, a sandblast, or the like, but are not limited thereto.

The cover layer 700 may be formed in a thickness range of 10 nm to 100 μm. When a thickness of the cover layer 700 is less than 10 nm, an insulation property may be weak, such that a short-circuit between an external device and the coil component may occur, and when a thickness of the cover layer 700 exceeds 100 μm, an entire length, width, and thickness of the coil component may be excessively increased, which is disadvantageous for thinness of the coil component.

The sum of the thicknesses of the insulating layer 600, the shielding layer 500, and the cover layer 700 may exceed 30 nm and be 100 μm or less. When the sum of the thicknesses of the insulating layer 600, the shielding layer 500, and the cover layer 700 is less than 30 nm, a problem such as an electrical short-circuit, a decrease in characteristics of the coil component such as a Q factor, and the like, may occur, and when the sum of the thicknesses of the insulating layer 600, the shielding layer 500, and the cover layer 700 exceeds 100 μm, the entire length, width, and thickness of the coil component may be excessively increased, which is disadvantageous for thinness of the coil component.

Meanwhile, although not illustrated in FIGS. 1 through 2E, an additional insulating layer distinguished from the insulating layer 600 may be formed on regions on which the external electrodes 300 and 400 are not formed on the surfaces of the body 100. That is, the additional insulating layer may be formed on the third to fifth surfaces of the body 100 on which the connection portions 310 and 410 are not formed and a region on which the extending portions 320 and 420 are not formed on the sixth surface of the body 100. In this case, the insulating layer 600 according to the present exemplary embodiment may be formed on the surfaces of the body 100 to be in contact with the additional insulating layer. The additional insulating layer may serve as a plating resist in forming the external electrodes 300 and 400 by plating, but is not limited thereto.

Since the insulating layer 600 and the cover layer 700 according to the present disclosure are disposed in the coil component itself, the insulating layer 600 and the cover layer 700 may be distinguished from a molding material molding the coil component and the printed circuit board in a process of mounting the coil component on the printed circuit board. Therefore, the insulating layer 600 according to the present disclosure may not be in contact with the printed circuit board. In addition, the insulating layer 600 and the cover layer 700 may not be supported or fixed by the printed circuit board unlike the molding material. In addition, unlike the molding material surrounding connection members such as solder balls connecting the coil component and the printed circuit board to each other, the insulating layer 600 and the cover layer 700 according to the present disclosure may not be formed to surround the connection members. In addition, since the insulating layer 600 according to the present disclosure is not the molding material formed by heating an epoxy molding compound (EMC), or the like, moving the EMC onto the printed circuit board, and then hardening the EMC, generation of voids at the time of forming the molding material, generation of warpage of the printed circuit board due to a difference between a CTE of the molding material and a CTE of the printed circuit board, and the like, need not to be considered.

In addition, since the shielding layer 500 according to the present disclosure is disposed in the coil component itself, the shielding layer 500 may be distinguished from a shield can coupled to the printed circuit board in order to shield EMI, or the like, after the coil component is mounted on the printed circuit board. As an example, it may not be considered to connect the shielding layer 500 according to the present disclosure to a ground layer of the printed circuit board, unlike the shield can. As another example, in the shielding layer 500 according to the present disclosure, a fixing member for fixing the shield canto the printed circuit board may not be required. That is, the shielding layer 500, as well as the seed layer SL, may be electrically floating.

In the coil component 100 according to the present exemplary embodiment, leakage magnetic flux generated in the coil component may be more efficiently blocked by forming the shielding layer 500 in the coil component itself. Although the drawings show that the present embodiment includes the shielding layer 500, the shielding layer 500 may be omitted in a case in which the seed layer SL effectively blocks leaked magnetic fluxes generated in the coil component. In accordance with thinness and performance improvement of an electronic device, the total number of electronic components included in the electronic device and a distance between adjacent electronic components has been decreased, but the shielding layer may shield the respective coil components themselves to more efficiently block leaked magnetic fluxes generated in the respective coil components, which may be more advantageous for thinness and performance improvement of the electronic device. In addition, in the coil component 1000 according to the present exemplary embodiment, an amount of effective magnetic material in a shielding region may be increased as compared to a case of using the shield can, and characteristics of the coil component may thus be improved.

Second Exemplary Embodiment

Figure 3:
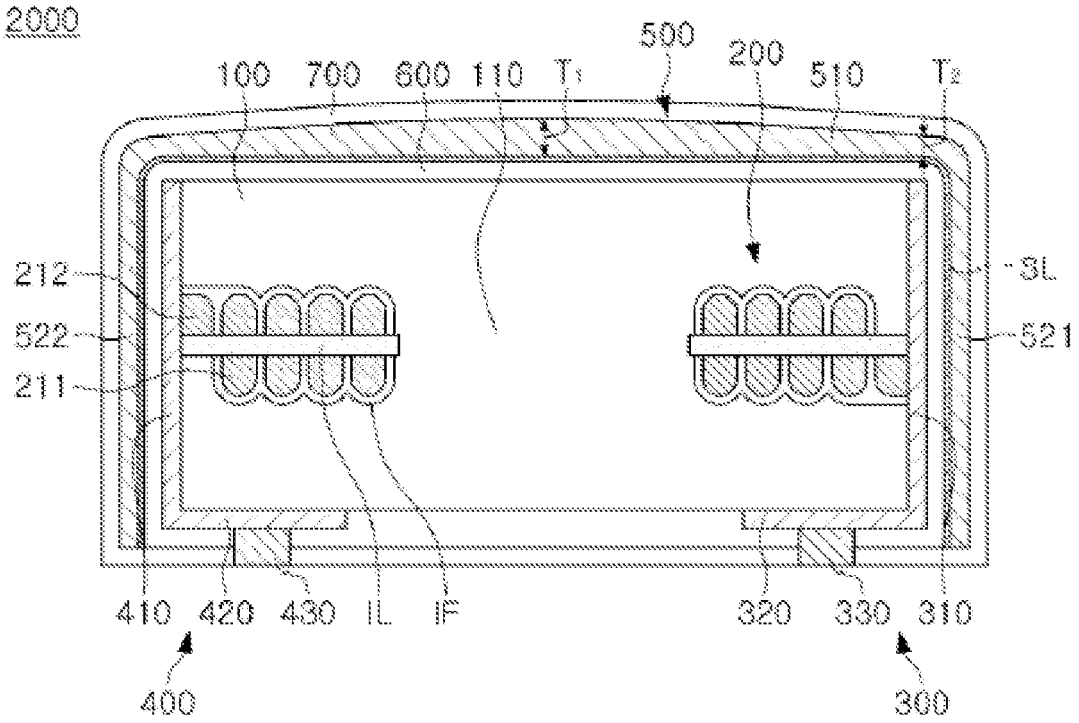
FIG. 3 is a cross-sectional view illustrating a coil component according to a second exemplary embodiment in the present disclosure and corresponding to a cross-sectional view taken along line I-I' of FIG. 1.

FIG. 3 is a cross-sectional view illustrating a coil component according to a second exemplary embodiment in the present disclosure and corresponding to a cross-sectional view taken along line I-I' of FIG. 1.

Referring to FIGS. 1 through 3, a coil component 2000 according to the present exemplary embodiment may be different in a cap portion 510 from the coil component 1000 according to the first exemplary embodiment in the present disclosure. Therefore, in describing the present exemplary embodiment, only the cap portion 510 different from that of the first exemplary embodiment in the present disclosure will be described. The description in the first exemplary embodiment in the present disclosure may be applied to other components of the present exemplary embodiment as it is.

Referring to FIG. 3, a central portion of the cap portion 510 may be formed to have a thickness $T_1$ greater than a thickness $T_2$ of an outer side portion thereof. This will be described in detail.

The respective coil patterns 211 and 212 constituting the coil portion 200 according to the present exemplary embodiment may form a plurality of turns from the center of the internal insulating layer IL to an outer side of the internal insulating layer IL on opposite surfaces of the internal insulating layer IL, respectively, and may be stacked in the thickness direction (T) of the body 100 and be connected to each other by the via 220 (refer to FIG. 2B). Resultantly, in the coil component 2000 according to the present exemplary embodiment, a magnetic flux density may be highest at a central portion of a length direction (L)-width direction (W) plane of the body 100 perpendicular to the thickness direction (T) of the body 100. Therefore, in the present exemplary embodiment, in forming the cap portion 510 disposed on the fifth surface of the body 100 substantially parallel with the length direction (L)-width direction (W) plane of the body 100, the central portion of the cap portion 510 may be formed to have the thickness $T_1$ greater than the thickness $T_2$ of the outer side portion thereof in consideration of a magnetic flux density distribution on the length direction (L)-width direction (W) plane of the body 100.

In this way, in the coil component 2000 according to the present exemplary embodiment, the cap portion 510 may be formed to have different thicknesses depending on the magnetic flux density distribution to more efficiently decrease leaked magnetic flux.

Third Exemplary Embodiment

Figure 4:
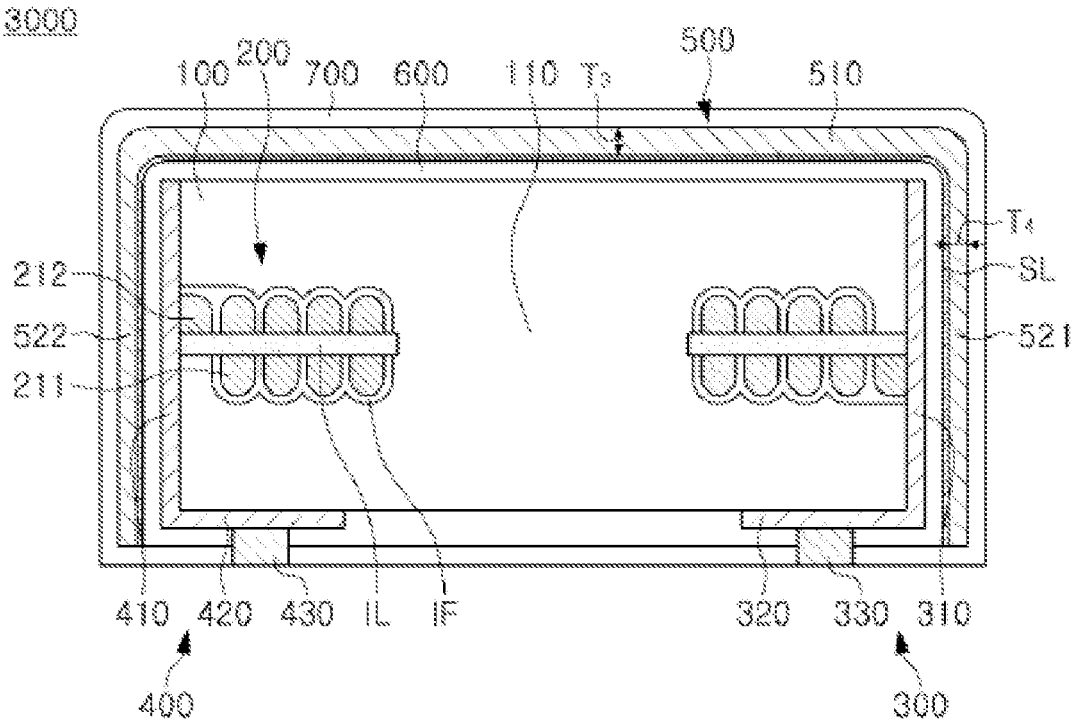
FIG. 4 is a cross-sectional view illustrating a coil component according to a third exemplary embodiment in the present disclosure and corresponding to a cross-sectional view taken along line I-I' of FIG. 1.
Figure 5:
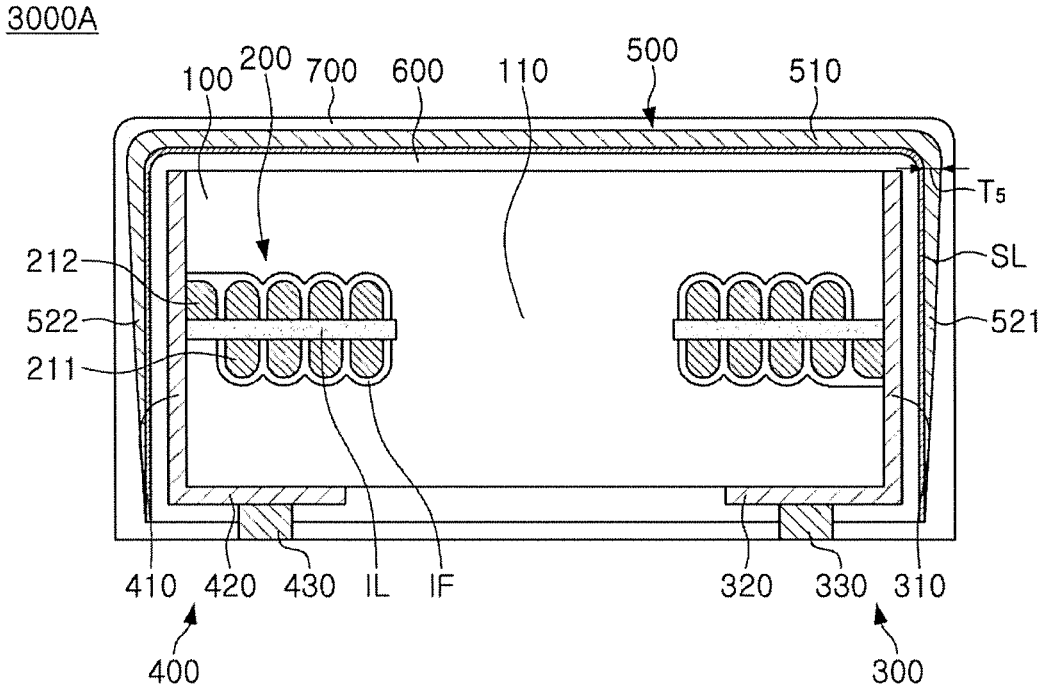
FIG. 5 is a cross-sectional view illustrating a coil component according to a modified example of a third exemplary embodiment in the present disclosure and corresponding to a cross-sectional view taken along line I-I' of FIG. 1.

FIG. 4 is a cross-sectional view illustrating a coil component according to a third exemplary embodiment in the present disclosure and corresponding to a cross-sectional view taken along line I-I' of FIG. 1. FIG. 5 is a cross-sectional view illustrating a coil component according to a modified example of a third exemplary embodiment in the present disclosure and corresponding to a cross-sectional view taken along line I-I' of FIG. 1.

Referring to FIGS. 1 through 5, a coil component 3000 and a coil component 3000A according to the present exemplary embodiments may be different in a cap portion 510 and sidewall portions 521, 522, 523, and 524 from the coil components 1000 and 2000 according to the first and second exemplary embodiments in the present disclosure. Therefore, in describing the present exemplary embodiment, only the cap portion 510 and the sidewall portions 521, 522, 523, and 524 different from those of the first and second exemplary embodiments in the present disclosure will be described. The description in the first or second exemplary embodiment in the present disclosure may be applied to other components of the present exemplary embodiment as it is.

Referring to FIG. 4, a thickness $T_3$ of the cap portion 510 may be greater than a thickness $T_4$ of each of the sidewall portions 521, 522, 523, and 524.

As described above, the coil portion 200 may generate a magnetic field in the thickness direction (T) of the body 100. Resultantly, a magnetic flux leaked in the thickness direction (T) of the body 100 may be greater than those leaked in other directions. Therefore, the cap portion 510 disposed on the fifth surface of the body 100 perpendicular to the thickness direction (T) of the body 100 may be formed to have a thickness greater than that of each of the sidewall portions 521, 522, 523, and 524 disposed on walls of the body 100 to more efficiently decrease the leaked magnetic flux.

Referring to FIGS. 4 and 5, in a case in which the cap portion 510 is formed to have the thickness $T_3$ greater than the thickness $T_4$ of each of the sidewall portions 521, 522, 523, and 524, a thickness $T_5$ of one end of a sidewall portion 520 may be greater than that of the other end of the sidewall portion 520.

As an example, when the cap portion 510 and the sidewall portions 521, 522, 523, and 524 are formed by plating, a current density may be concentrated due to edged shapes in edge portions of the body 100 at which the fifth surface of the body 100 and the first to fourth surfaces of the body 100 are connected to each other, that is, regions in which one end of the sidewall portion 520 is formed. Therefore, one end of the sidewall portion 520 may be formed to have a thickness relatively greater than that of the other end of the sidewall portion 520. As another example, one end of the sidewall portion 520 may be formed to have a thickness relatively greater than that of the other end of the sidewall portion 520 by disposing the body 100 so that the fifth surface of the body 100 faces a target and then performing sputtering for forming the shielding layer 500. However, the scope of the present exemplary embodiment is not limited to the example described above.

In this way, in the coil components 3000 and 3000A according to the present exemplary embodiments, the leaked magnetic flux may be efficiently decreased in consideration of a direction of a magnetic field formed by the coil portion 200.

Fourth Exemplary Embodiment

Figure 6A:
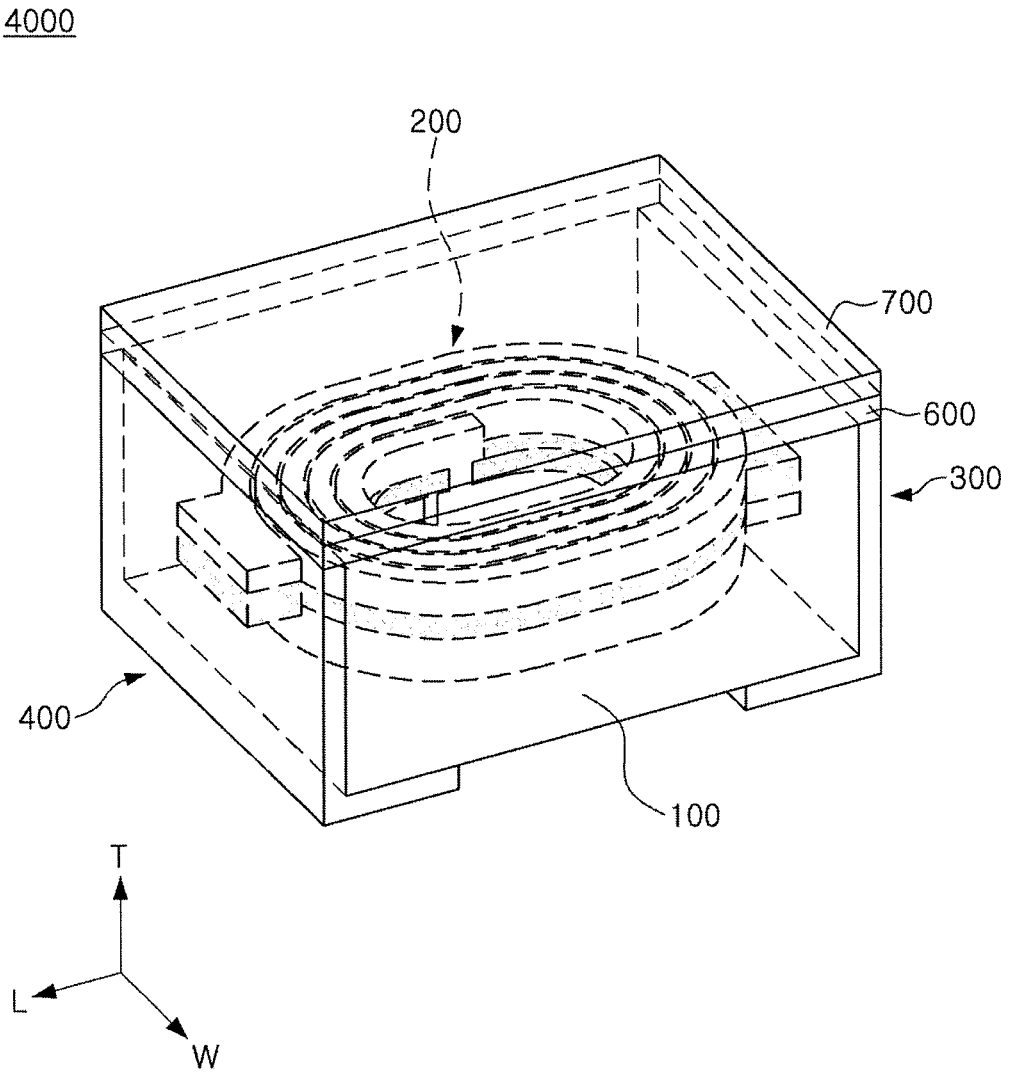
FIG. 6A is a schematic perspective view illustrating a coil component according to a fourth exemplary embodiment in the present disclosure.
Figure 6B:
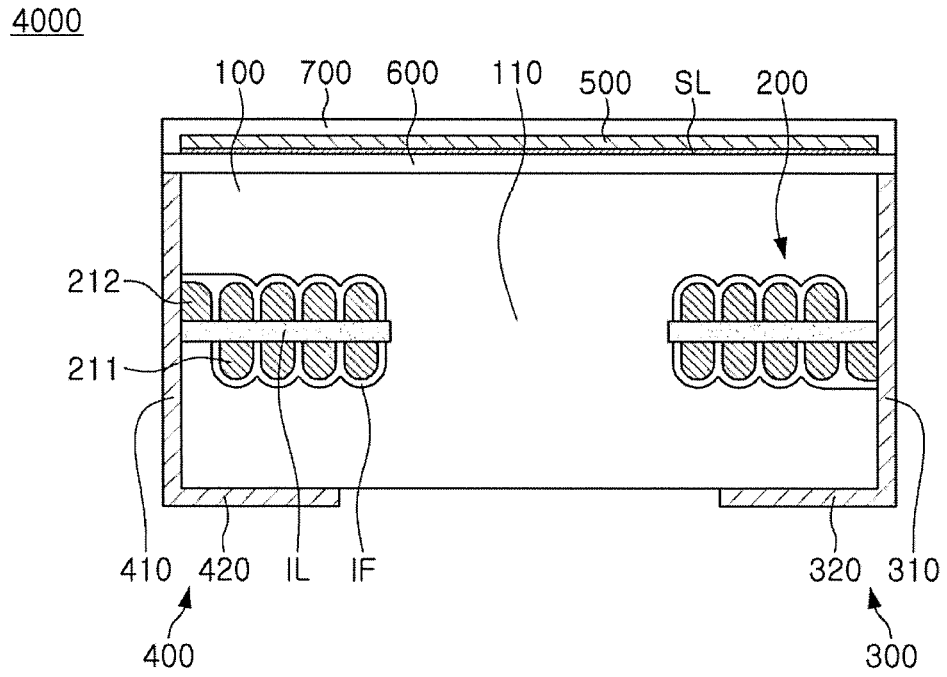
FIG. 6B is a cross-sectional view taken along an LT plane of FIG. 6A.

FIG. 6A is a schematic perspective view illustrating a coil component according to a fourth exemplary embodiment in the present disclosure. FIG. 6B is a cross-sectional view taken along an LT plane of FIG. 6A.

Referring to FIGS. 1 through 63, a coil component 4000 according to the present exemplary embodiment may be different in a structure of a shielding layer 500 from the coil components 1000, 2000, and 3000 according to the first to third exemplary embodiments in the present disclosure. Therefore, in describing the present exemplary embodiment, only those different from those of the first to third exemplary embodiments in the present disclosure will be described. The description in the first to third exemplary embodiments in the present disclosure may be applied to other components of the present exemplary embodiment as it is.

In detail, in the present exemplary embodiment, the shielding layer 500 may include only a cap portion. Other elements including the first external electrode 300, the second external electrode 400, the insulating layer 600, the seed layer SL, and the cover layer 700 may be modified accordingly. For example, the insulating layer 600, the seed layer SL, and the cover layer 700, similar to the shielding layer, may be modified to be formed only on the fifth surface of the body 100. In this case, the first penetrating portion 330 of the first external electrode 300 and the second penetrating portion 430 of the second external electrode 400 included in the first to third exemplary embodiments may be omitted.

As described above in another exemplary embodiment in the present disclosure, in the coil portion 200, the largest leaked magnetic flux may be generated in the thickness direction (T) of the body 100. Therefore, in the present exemplary embodiment, the shielding layer 500 may be formed on only the fifth surface of the body 100 perpendicular to the thickness direction (T) of the body 100 to more simply and efficiently block the leaked magnetic flux.

Fifth Exemplary Embodiment

Figure 7:
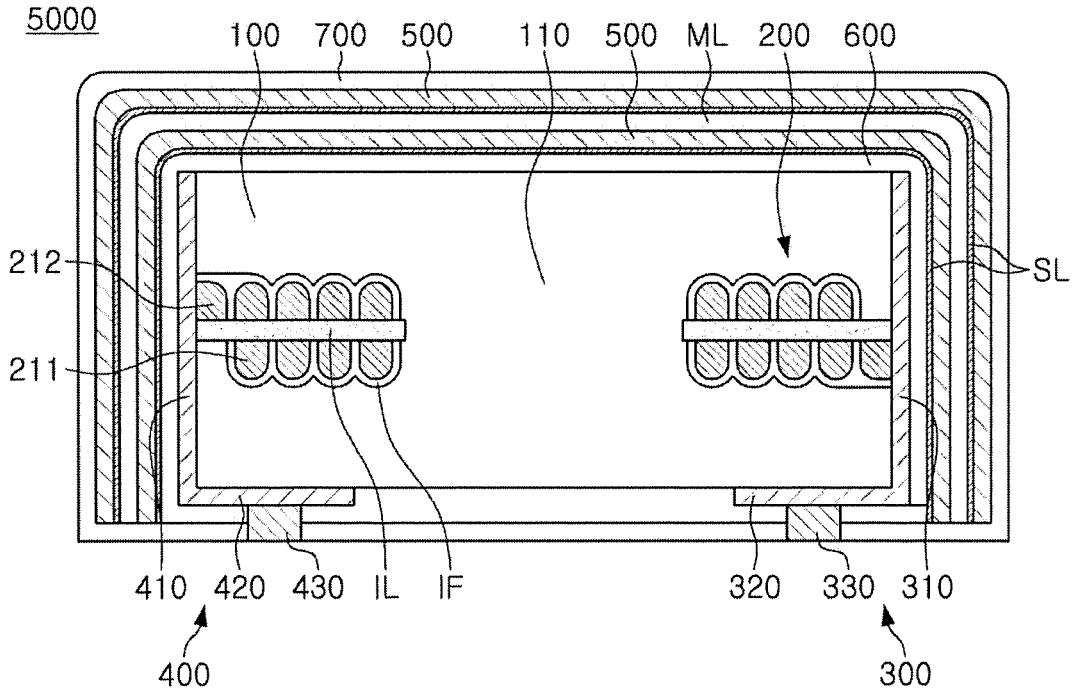
FIG. 7 is a cross-sectional view illustrating a coil component according to a fifth exemplary embodiment in the present disclosure and corresponding to a cross-sectional view taken along line I-I' of FIG. 1.

FIG. 7 is a cross-sectional view illustrating a coil component according to a fifth exemplary embodiment in the present disclosure and corresponding to a cross-sectional view taken along line I-I' of FIG. 1.

Referring to FIGS. 1 through 7, a coil component 5000 according to the present exemplary embodiment may be different in a structure of shielding layers 500 from the coil components 1000, 2000, 3000, and 4000 according to the first to fourth exemplary embodiments in the present disclosure. Therefore, in describing the present exemplary embodiment, only the shielding layers 500 different from those of the first to fourth exemplary embodiments in the present disclosure will be described. The description in the first to fourth exemplary embodiments in the present disclosure may be applied to other components of the present exemplary embodiment as it is.

Referring to FIG. 7, the shielding layers 500 according to the present exemplary embodiment may be formed in a double layer structure in which a middle insulating layer ML is interposed therebetween.

In the present exemplary embodiment, the shielding layers 500 may be formed in the double layer structure, and leakage magnetic flux passing through a first shielding layer 500 disposed relatively adjacent to the body 100 may thus be shielded by a second shielding layer 500 disposed to be relatively spaced apart from the body 100. Therefore, in the coil component 5000 according to the present exemplary embodiment, the leaked magnetic flux may be more efficiently blocked. In addition, the middle insulating layer ML may serve as a wave guide of noise reflected from the second shielding layer 500.

The description for the insulating layer 600 in the first to fourth exemplary embodiments in the present disclosure may be applied to a material of the middle insulating layer ML, a method of forming the middle insulating layer ML, and the like, as it is.

Modified Examples

Figure 8A:
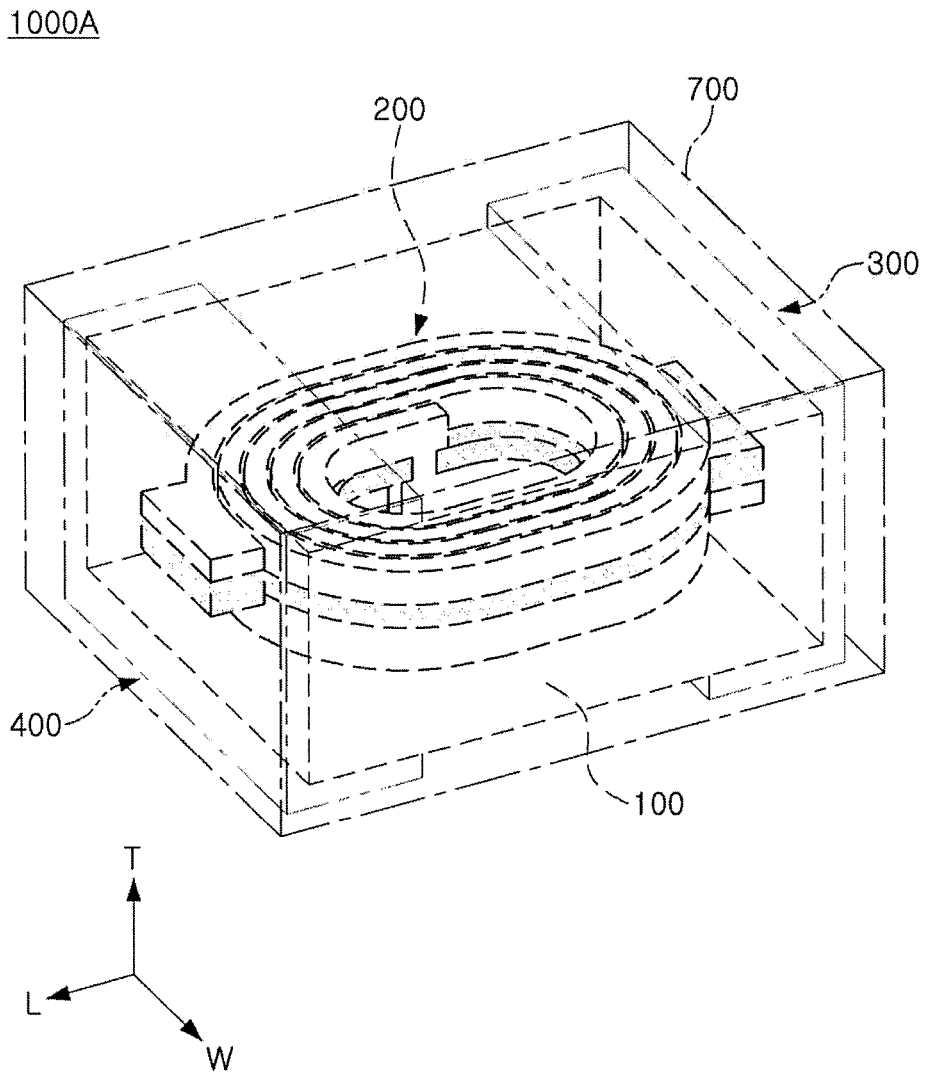
FIGS. 8A through 11 are schematic views illustrating modified examples in the present disclosure.
Figure 8B:
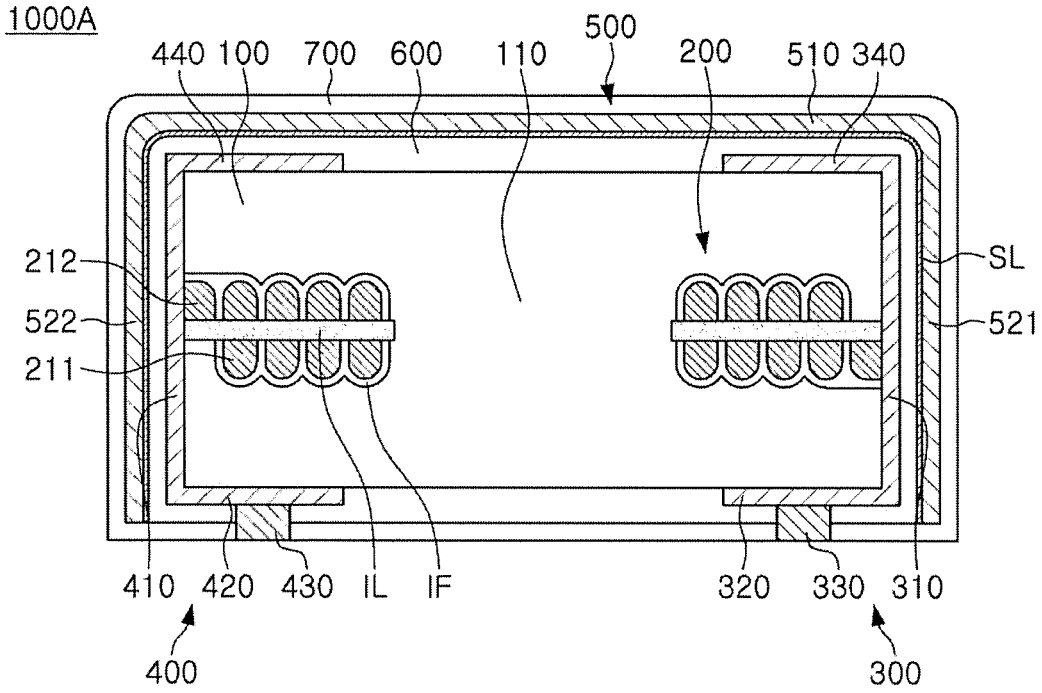
Figure 8C:
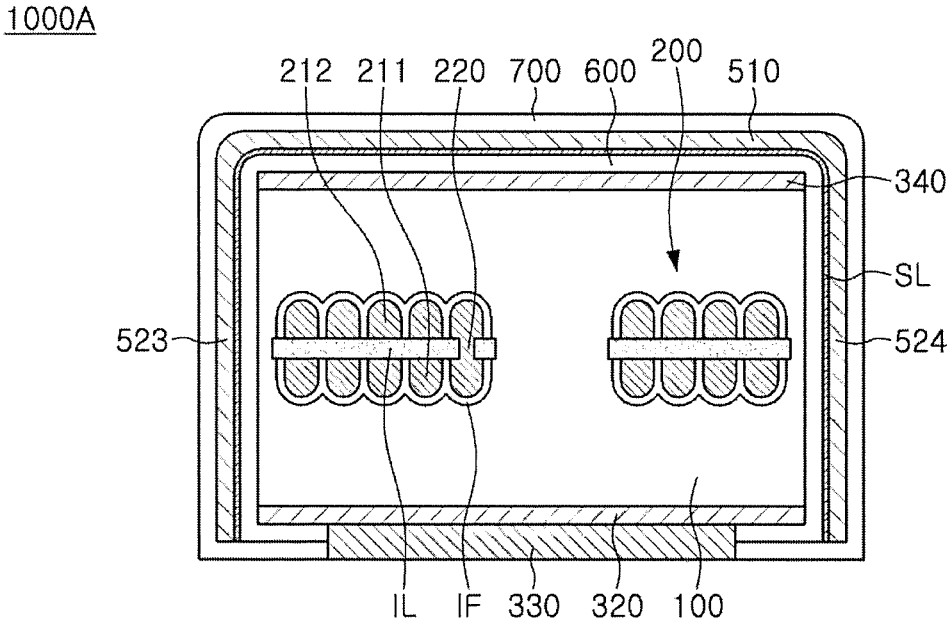
Figure 9A:
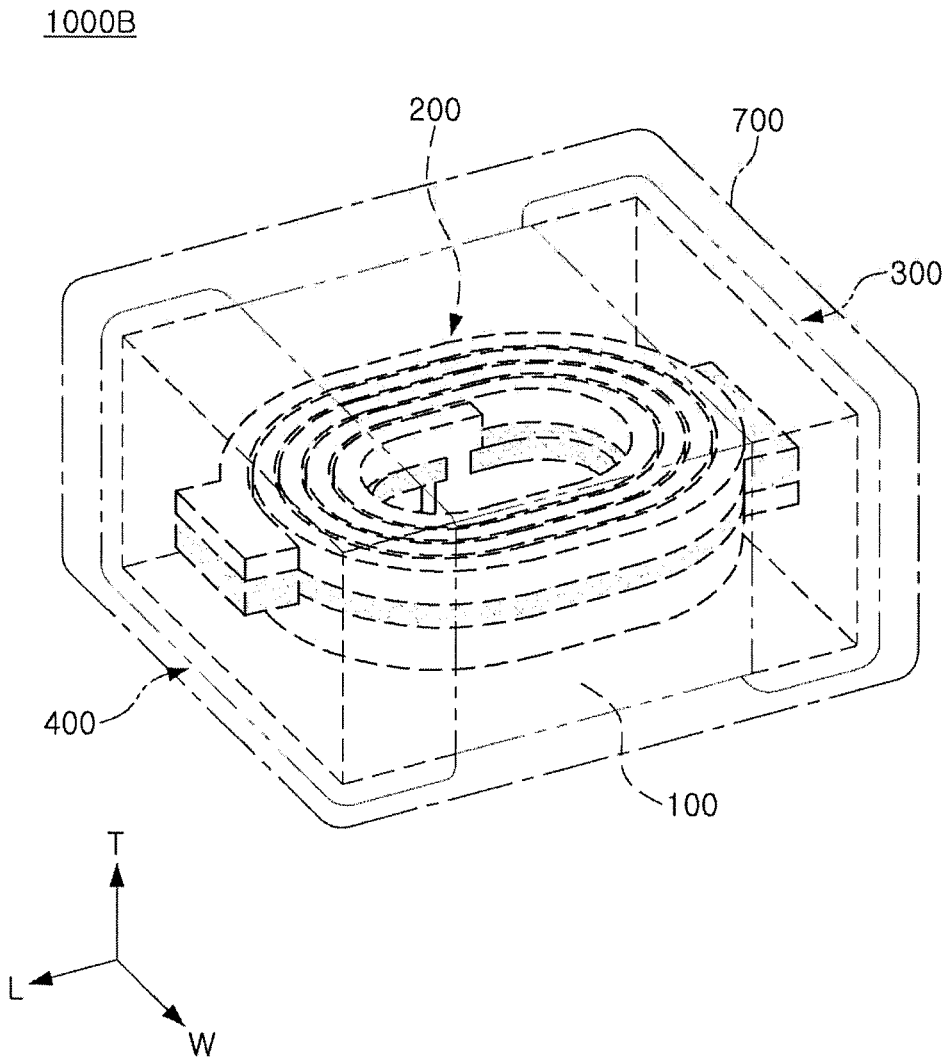
Figure 9B:
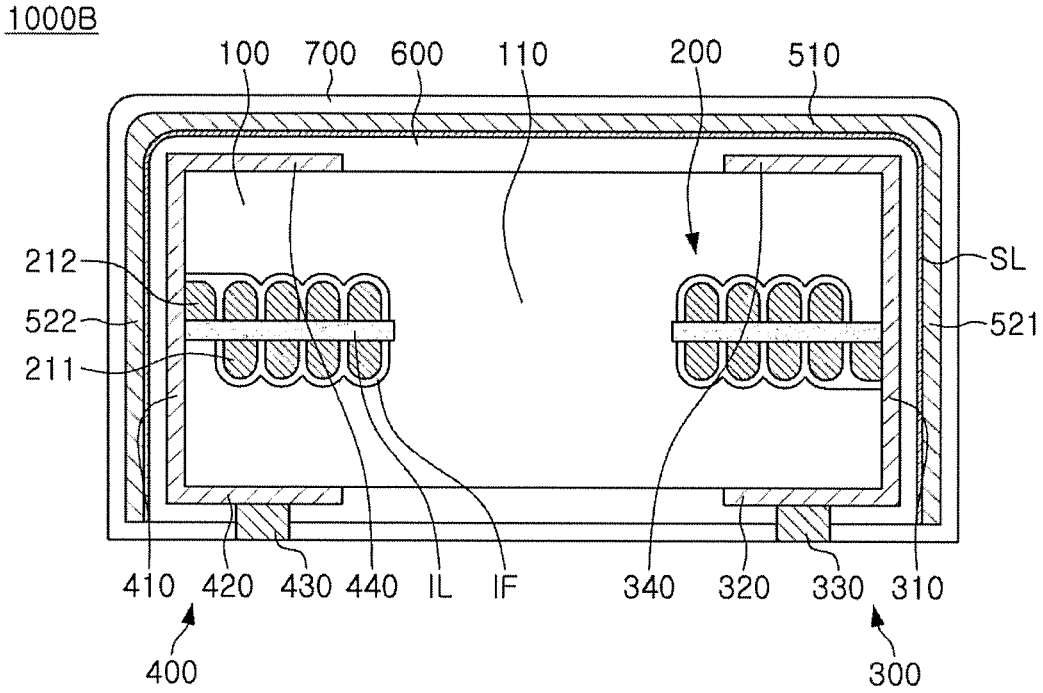
Figure 9C:
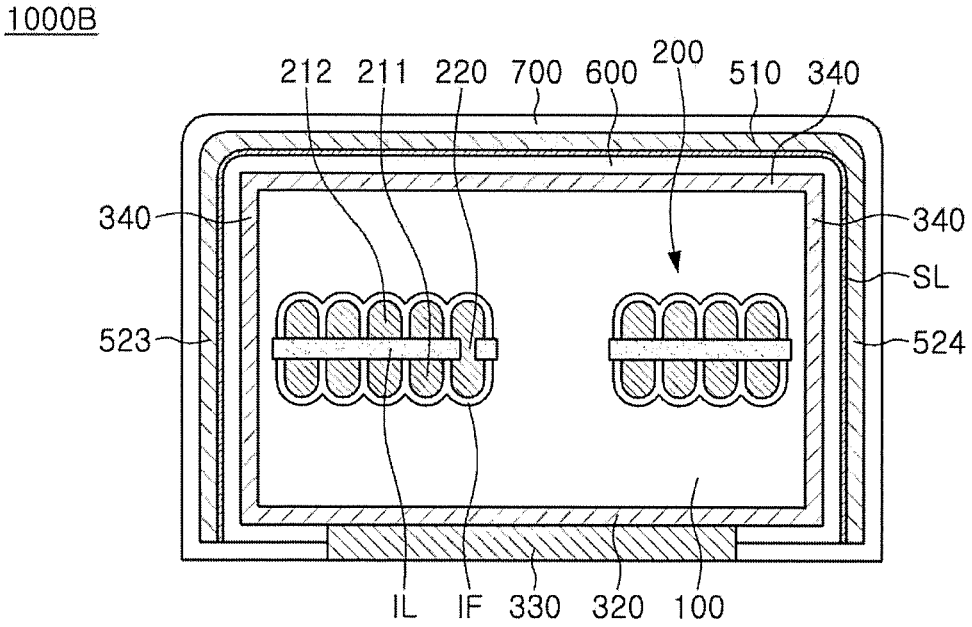
Figure 10:
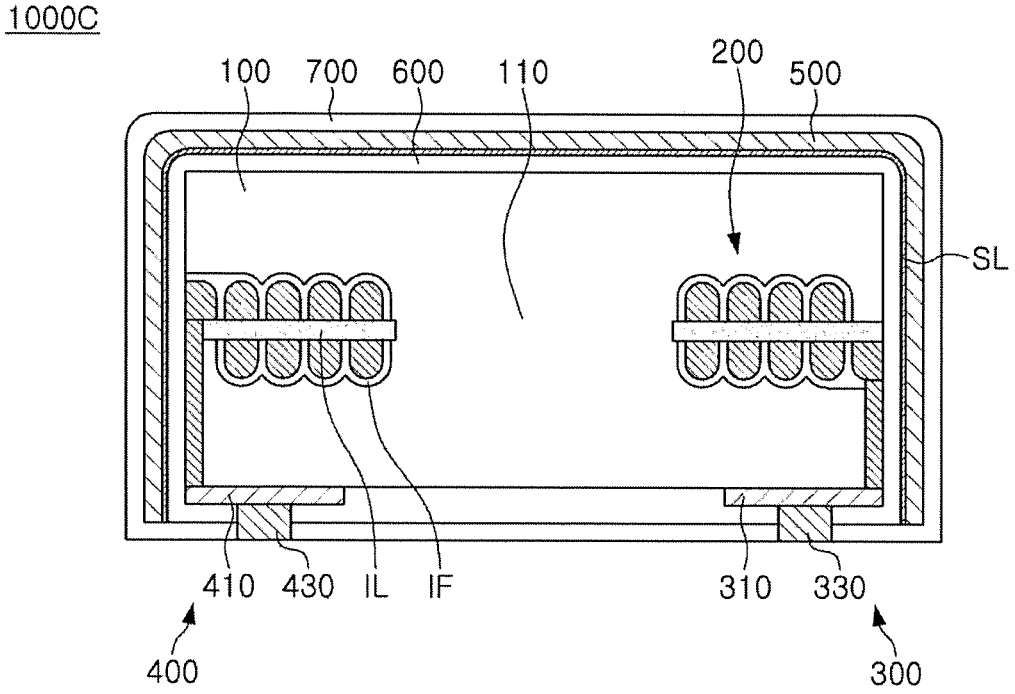

FIGS. 8A through 10 are schematic views illustrating first to third modified examples in the present disclosure. In detail, FIG. 8A is a perspective view illustrating a coil component according to a first modified example, FIG. 8B is a cross-sectional view taken along an LT plane of FIG. 8A, and FIG. 8C is a cross-sectional view taken along a WT plane of FIG. 8A. FIG. 9A is a perspective view illustrating a coil component according to a second modified example, FIG. 9B is a cross-sectional view taken along an LT plane of FIG. 9A, and FIG. 9C is a cross-sectional view taken along a WT plane of FIG. 9A. FIG. 10 is a cross-sectional view illustrating a coil component according to a third modified example and corresponding to a cross-sectional view taken along line I-I' of FIG. 1.

Referring to FIGS. 8A through 10, the coil component according to the present disclosure may have coil components 1000A, 1000B, and 1000C according to first to third modified examples in which shapes of external electrodes 300 and 400 are modified.

In detail, referring to FIGS. 8A through 8C, in the coil component 1000A according to the first modified example in the present disclosure, the external electrodes 300 and 400 may further include band portions 340 and 440 extending from the connection portions 310 and 410 to the fifth surface of the body 100, respectively. As an example, a first external electrode 300 may further include a first band portion 340 extending from the first connection portion 310 to the fifth surface of the body 100, and a first external electrode 400 may further include a second band portion 440 extending from the second connection portion 410 to the fifth surface of the body 100. That is, in the present modified example, the external electrodes 300 and 400 may be electrodes having a '⊏' shape.

Referring to FIGS. 9A through 9C, in the coil component 1000B according to the second modified example in the present disclosure, the external electrodes 300 and 400 may further include band portions 340 and 440 extending from the connection portions 310 and 410 to the third to fifth surfaces of the body 100, respectively. As an example, a first external electrode 300 may further include a first band portion 340 extending from the first connection portion 310 and disposed on the third to fifth surfaces of the body 100. That is, in the present modified example, the external electrodes 300 and 400 may be five-sided electrodes.

Referring to FIG. 10, in the coil component 1000C according to the third modified example in the present disclosure, connection portions 310 and 410 of the external electrodes 300 and 400 may be formed on the sixth surface of the body 100. In this case, end portions of the first coil pattern 211 and the second coil pattern 212 are not exposed to the first and second surfaces of the body 100, respectively, but may be exposed to the sixth surface of the body 100 and be connected to the connection portions 310 and 410 of the external electrodes 300 and 400. The end portion of the second coil pattern 212 may penetrate through the internal insulating layer IL and the body 100, and be exposed to the sixth surface of the body 100.

Figure 11:
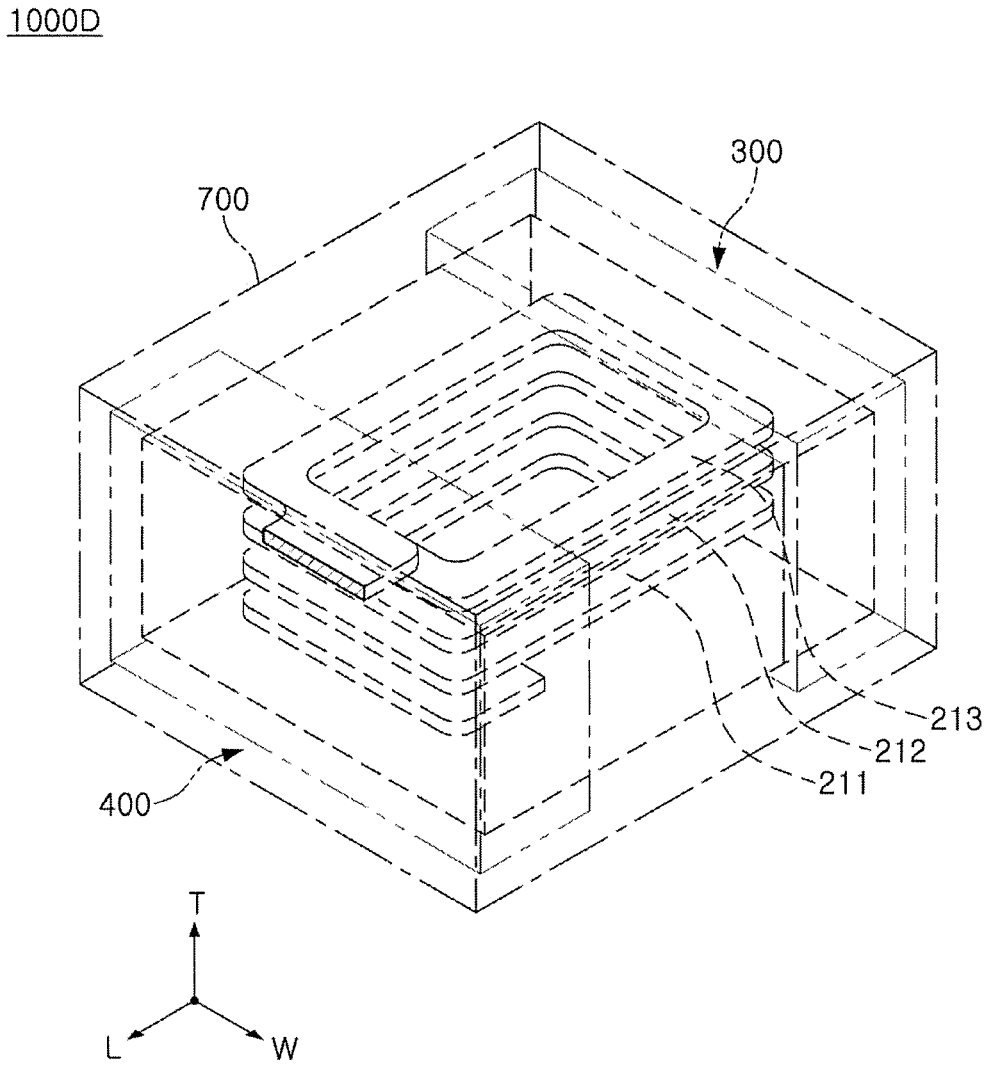

FIG. 11 is a schematic view illustrating a fourth modified example in the present disclosure.

Referring to FIG. 11, the coil component according to the present disclosure may have a coil component 1000D according to a fourth modified example in which a form of a coil portion is modified.

In detail, referring to FIG. 11, the coil portion 200 according to the present modified example may be formed in a structure in which a plurality of coil patterns 211, 212, and 213 are stacked in the thickness direction (T) of the body 100. Here, the plurality of coil patterns 211, 212, and 213 may be connected to one another by a connection via (not illustrated) formed in the thickness direction (T) of the body to constitute one coil portion 200.

The coil component according to the present modified example may not include the internal insulating layer IL (see FIG. 2A) and the insulating film IF (see FIG. 2A) according to the first exemplary embodiment in the present disclosure.

In the present modified example, the body 100 may be formed by stacking a plurality of magnetic composite sheets to which a conductive paste for forming the coil portion 200 is applied. In this case, via holes for forming the connection via may be drilled in at least portions of the magnetic composite sheets constituting the body. The via hole may be formed by applying a conductive paste, similar to the coil portion.

Meanwhile, although not illustrated, a coil component having a coil portion formed by sequentially stacking the respective coil patterns formed perpendicular to the sixth surface of the body in the length direction or the width direction of the body may also be included in the modified example in the present disclosure.

In addition, FIGS. 8A through 11 illustrate the coil components 1000A, 1000B, 1000C, and 1000D according to the modified examples in the present disclosure in relation to the first exemplary embodiment in the present disclosure, but the modified examples described above may be similarly applied to the second to fifth exemplary embodiments in the present disclosure.

As set forth above, according to an exemplary embodiment in the present disclosure, leakage magnetic flux of the coil component may be decreased.

In addition, characteristics of the coil component may be substantially maintained while decreasing the leaked magnetic flux of the coil component.

While exemplary embodiments have been shown and described above, it will be apparent to those skilled in the art that modifications and variations could be made without departing from the scope of the present invention as defined by the appended claims.

What is claimed is:

1. A coil component comprising:

a body having a first surface and a second surface opposing each other in one direction;

a coil portion including a coil pattern embedded in the body and having at least one turn in the one direction;

an insulating layer surrounding the body and having an opening:

an external electrode connected to the coil portion, penetrating through the opening of the insulating layer, and disposed on the first surface of the body;

a shielding layer disposed on the insulating layer and disposed at least on the second surface of the body; and a seed layer disposed between the insulating layer and the shielding layer, wherein at least portions of the seed layer penetrate into the insulating layer, and the external electrode is in contact with only an inner wall of the opening among surfaces of the insulating layer.

2. The coil component of claim 1, wherein the seed layer and the insulating layer include a mixed layer in which particles of a material constituting the seed layer penetrate into the insulating layer.

3. The coil component of claim 1, wherein a thickness of a portion of the shielding layer on a central portion of the second surface of the body is greater than a thickness of a portion of the shielding layer on an outer side portion of the second surface of the body.

4. The coil component of claim 1, wherein the shielding layer includes at least one of a conductor and a magnetic material.

5. The coil component of claim 1, further comprising a cover layer covering the shielding layer.

6. The coil component of claim 5, wherein the shielding layer is completely embedded in the cover layer and the insulating layer.

7. The coil component of claim 1, wherein the shielding layer includes:

a cap portion disposed on the second surface of the body; and sidewall portions extending from the cap portion and disposed on walls of the body connecting the first surface and the second surface of the body to each other.

8. The coil component of claim 7, wherein the cap portion has a thickness greater than that of the sidewall portion.

9. The coil component of claim 7, wherein one end of the sidewall portion connected to the cap portion has a thickness greater than that of another end of the sidewall portion.

10. The coil component of claim 7, further comprising a cover layer disposed on the sidewall portions and the cap portion to cover the shielding layer.

11. The coil component of claim 10, wherein the cover layer extends onto the first surface of the body, and the external electrode penetrates through the cover layer.

12. The coil component of claim 7, wherein the number of walls of the body is plural, and the sidewall portions are disposed on the plurality of walls of the body, respectively.

13. The coil component of claim 12, wherein a plurality of sidewall portions and the cap portion are formed integrally with each other.

14. The coil component of claim 7, wherein the external electrode includes:

a connection portion disposed on the wall of the body and connected to the coil portion;

an extending portion extending from the connection portion to the first surface of the body; and a penetrating portion penetrating through the opening of the insulating layer and connected to the extending portion, and the insulating layer covers the connection portion and the extending portion.

15. The coil component of claim 14, wherein each of the connection portion and the extending portion includes copper.

16. The coil component of claim 15, wherein the penetrating portion includes at least one of copper (Cu), tin (Sn), and nickel (Ni).

17. The coil component of claim 1, wherein the seed layer includes at least one of titanium (Ti), chromium (Cr), and copper (Cu).

18. The coil component of claim 17, wherein insulating layer includes one selected from the group consisting of polystyrenes, vinyl acetates, polyesters, polyethylenes, polypropylenes, polyamides, rubbers, acryls, phenols, epoxies, urethanes, melamines, alkyds, a photosensitive resin, and a combination thereof.

19. The coil component of claim 1, wherein the shielding layer includes copper (Cu).

20. The coil component of claim 1, further comprising:

another insulating layer disposed on the shielding layer;

another shielding layer disposed on the another insulating layer; and another seed layer disposed between the another insulating layer and the another shielding layer.

21. The coil component of claim 1, wherein the insulating layer is an integral layer continuously extending from the second surface to cover at least a portion of the first surface.

22. A coil component comprising:

a body having a first surface and a second surface opposing each other in one direction and walls connecting the first surface and the second surface to each other;

a coil portion embedded in the body, and including coil patterns and an internal insulating layer stacked in the one direction;

first and second external electrodes disposed on the first surface of the body to be spaced apart from each other and each connected to the coil portion;

an external insulating layer covering the body and the first and second external electrodes;

a shielding layer disposed on the external insulating layer, and including a cap portion disposed on the second surface of the body and sidewall portions disposed on the walls of the body;

a seed layer disposed between the external insulating layer and the shielding layer and having at least portions penetrating into the external insulating layer; and penetration electrodes disposed on the first surface of the body, penetrating through the external insulating layer, and respectively connected to the first and second external electrodes, wherein a thickness of a portion of the shielding layer on a central portion of the second surface of the body is greater than a thickness of a portion of the shielding layer on an outer side portion of the second surface of the body.

23. A coil component comprising:

a body having first and second surfaces opposing each other in a length direction of the body, third and fourth surfaces opposing each other in a width direction, and fifth and sixth surfaces opposing each other in a thickness direction;

a coil portion including a coil pattern embedded in the body;

first and second external electrodes connected to the coil portion, and extending onto the sixth surface;

an insulating layer disposed on the body, and having first and second openings exposing portions of the first and second electrodes disposed on the sixth surface, the first and second openings of the insulating layer being filled with first and second penetration electrodes, respectively;

a first electrically conductive layer disposed on the insulating layer and covering at least a portion of the fifth surface; and an insulating cover layer covering the shielding layer, wherein the first and second penetration electrodes are connected to the first and second external electrodes, respectively, and a thickness of a portion of the shielding layer on a central portion of the fifth surface of the body is greater than a thickness of a portion of the shielding layer on an outer side portion of the fifth surface of the body.

24. The coil component of claim 23, wherein a portion of the first electrically conductive layer penetrates into the insulating layer.

25. The coil component of claim 24, wherein the first electrically conductive layer and the insulating layer include a mixed layer in which particles of a material constituting the first electrically conductive layer penetrate into the insulating layer.

26. The coil component of claim 23, further comprising a second electrically conductive layer covering the first electrically conductive layer.

27. The coil component of claim 23, wherein the first electrically conductive layer covers at least the entire fifth surface of the body.

28. The coil component of claim 27, wherein the first electrically conductive layer extends from the fifth surface of the body onto at least portions of the first to fourth surfaces of the body not covered by the first and second external electrodes.

29. The coil component of claim 28, wherein the first electrically conductive layer covers the first and second external electrodes.

30. The coil component of claim 23, wherein the cover layer covers an entirety of the body except portions of the body on which the first and second openings are disposed.

31. The coil component of claim 23, wherein the first electrically conductive layer is electrically floating.

32. The coil component of claim 23, wherein the first and second penetration electrodes are spaced apart from edges of the sixth surface of the body.

* * * * *